US006374730B1

(12) United States Patent
Kuratani et al.

(10) Patent No.: US 6,374,730 B1
(45) Date of Patent: Apr. 23, 2002

(54) STENCIL PRINTER FOR DUPLEX PRINTING

(75) Inventors: Yasushi Kuratani; Hideaki Nogi; Tomohiro Mizutani, all of Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/475,244

(22) Filed: Dec. 30, 1999

(30) Foreign Application Priority Data

Jan. 4, 1999 (JP) ..... 11-000066

(51) Int. Cl.[7] ..... B41L 13/04
(52) U.S. Cl. ..... 101/115; 101/116; 101/118
(58) Field of Search ..... 101/115, 116, 101/117, 118, 119, 120, 129

(56) References Cited

U.S. PATENT DOCUMENTS

| | | | | | |
|---|---|---|---|---|---|
| 4,936,211 | A | * | 6/1990 | Pensavecchia et al. | 101/177 |
| 4,967,660 | A | * | 11/1990 | Yamanari et al. | 101/183 |
| 5,469,787 | A | * | 11/1995 | Turner et al. | 101/177 |
| 5,544,580 | A | * | 8/1996 | Takahashi | 101/118 |
| 5,671,670 | A | * | 9/1997 | Takahashi et al. | 101/116 |
| 6,067,902 | A | * | 5/2000 | Takahashi | 101/115 |
| 6,076,458 | A | * | 6/2000 | Ohno | 101/119 |

FOREIGN PATENT DOCUMENTS

| | | | | |
|---|---|---|---|---|
| DE | 442934 | | 4/1927 | |
| JP | 162650 | * | 8/1985 | 101/115 |
| JP | 04-105984 | | 4/1992 | |
| JP | 4-105984 | | 4/1992 | |
| JP | 118774 | * | 5/1996 | |
| JP | 10006632 | | 1/1998 | |
| JP | 34468 | * | 2/1999 | |
| JP | 11034468 | | 9/1999 | |
| WO | WO 98/55312 | | 12/1998 | |

OTHER PUBLICATIONS

Translation for JP 11–34468.*

* cited by examiner

*Primary Examiner*—Stephen R. Funk
(74) *Attorney, Agent, or Firm*—Nixon Peabody LLP; Donald R. Studebaker

(57) ABSTRACT

Disclosed herein is a stencil printer including a rotatable paper pinch drum with a cutout, a plurality of printing drums, and a position control unit. The cutout is formed in a portion of the outer peripheral surface of the rotatable paper pinch drum along a generating line in the axial direction of the drum. The plurality of printing drums have axes parallel with an axis of the paper pinch drum and disposed around and near the paper pinch drum so that the printing drums rotate in synchronization with the paper pinch drum in the opposition direction from the direction of rotation of the paper pinch drum. Each of the printing drums includes a stencil paper clamper which clamps one end of a paper stencil wound around the outer peripheral surface of the printing drum and an internal press roller which supplies ink to the stencil paper. Printing is performed on printing paper held on the outer peripheral surface of the paper pinch drum when the printing drums and the paper pinch drum rotate so that the paper stencil anchors of the printing drums are received in order in the cutout of the paper pinch drum. The position control unit independently controls each movement of the internal press rollers of the printing drums between an operative position which performs printing on the printing paper and an inoperative position which performs no printing.

10 Claims, 7 Drawing Sheets

STENCIL PRINTER FOR DUPLEX PRINTING

BACKGROUND OF THE INVENTION

1. Field of the Invention

This invention relates generally to a stencil printer, and more particularly to a polychromatic stencil printer which disposes a plurality of printing drums each having a stencil paper wound around the outer peripheral surface thereof, around a single paper pinch drum so that a polychromatic image such as a color image can be formed on printing paper held on the outer peripheral surface of the paper pinch drum.

2. Description of the Related Art

A conventional polychromatic stencil printer is shown in Japanese Unexamined Patent Publication No. 4(1992)-105984 by way of example. In such a stencil printer, a plurality of printing drums are disposed around a paper pinch drum. The paper pinch drum is formed with a cutout along the generating line of the outer peripheral surface. Each printing drum has a stencil paper anchor, which anchors one end of a stencil paper wound around the outer peripheral surface of the drum, on a portion along the generating line of the outer peripheral surface and includes an internal press roller (an ink-containing roller) in the interior. In rotating the paper pinch drum and the printing drum in opposite directions in synchronization with each other, with the cutout and the stencil paper anchor opposed to each other, ink is supplied to the stencil paper via the internal press roller, whereby printing is performed on the printing paper held on the paper pinch drum.

In the conventional polychromatic stencil printer of the above kind, incidentally, polychromatic printing can be performed on one side of the printing paper by single paper conveyance. However, when duplex polychromatic printing is performed, the printing paper printed on one side must be turned over and reprinted.

SUMMARY OF THE INVENTION

In view of the foregoing observations and description, the primary object of the present invention is to provide a stencil printer which is capable of easily performing duplex polychromatic printing by single paper conveyance similarly to single-side polychromatic printing.

To achieve this end, the stencil printer according to the present invention is provided with position control means. The position control means independently controls movement of the internal press roller of each printing drum between an operative position which performs printing on printing paper and an inoperative position which performs no printing. In this way, it is easy to perform single-side monochromatic printing with all the printing drums. It is also easy to perform single-side printing with at least one printing drum selected from a plurality of printing drums. Furthermore, performing duplex printing is easy.

In a preferred form of the present invention, the stencil printer further includes reference position detection means which detects a reference position in the direction of rotation of the paper pinch drum or a plurality of printing drums and rotational position detection means which detects a position of rotation from the reference position of the paper pinch drum or the plurality of printing drums, based on information detected by the reference position detection means. The position control means controls the internal press roller, based on information from the rotational position detection means. In this way, the position control means can move the internal press roller at correct timing.

In another preferred form of the present invention, the position control means moves the internal press roller to the operative position when the position of rotation of the paper pinch drum or the plurality of printing drums, detected by the rotational position detection means, coincides with a predetermined operation start point for the internal press roller.

In still another preferred form of the present invention, the position control means moves the internal press roller to the inoperative position when the position of rotation of the paper pinch drum or the plurality of printing drums, detected by the rotational position detection means, coincides with a predetermined operation end point for the internal press roller.

In the case where printing is performed on one side of the printing paper, mirror-image stencil papers which can print a non-reverse image on the obverse side of the printing paper are wound around the plurality of printing drums, and the position control means moves the internal press rollers of the plurality of mirror image printing drums to the operative positions in order from the internal press roller of the mirror image printing drum on an upstream side of a conveying path of the printing paper.

In the case where printing is performed on both sides of the printing paper, a mirror image stencil paper which can print a non-reverse image on the obverse side of the printing paper is wound around at least one of the plurality of printing drums, and a non-reverse image stencil paper which can print a mirror image on the outer peripheral surface of the paper pinch drum is wound around at least one of the remaining printing drums. The position control means moves only the internal press roller of the non-reverse image printing drum to the operative position and prints the mirror image on the outer peripheral surface of the paper pinch drum, without winding the printing paper around the paper pinch drum, and then moves the internal press roller of the non-reverse image printing drum to the inoperative position and the internal press roller of the mirror image printing drum to the operative position, with the printing paper wound around the paper pinch drum, and prints the non-reverse image on the obverse side of the printing paper and transfers the mirror image printed on the outer peripheral surface of the paper pinch drum to the reverse side of the printing paper as a non-reverse image.

In this case, the printing drum of the plurality of printing drums on the most downstream side of the conveying path of the printing paper can be employed as a press printing drum winding a non-perforated stencil paper. In this way, a stable transfer of an image to the reverse side of printing paper can be performed without providing an additional pressure roller.

In a further preferred form of the present invention, the paper pinch drum is directly driven to rotate by a drive source via a first rotation transmission system and the plurality of printing drums are driven to rotate by the paper pinch drum via a second rotation transmission system. Because a plurality of printing drums can be driven under the same condition, a phase difference between the printing drums can be prevented.

Furthermore, it is preferable that guide rollers, which press the printing paper on the paper pinch drum by contacting the paper pinch drum being driven to rotate and are driven by the paper pinch drum, be disposed between the plurality of printing drums. When only a specific printing drum of a plurality of printing drums is employed in printing, the rear end of printing paper can be prevented from being stained with ink in the non-printing drums.

DESCRIPTION OF THE PREFERRED EMBODIMENTS

Figure 1:
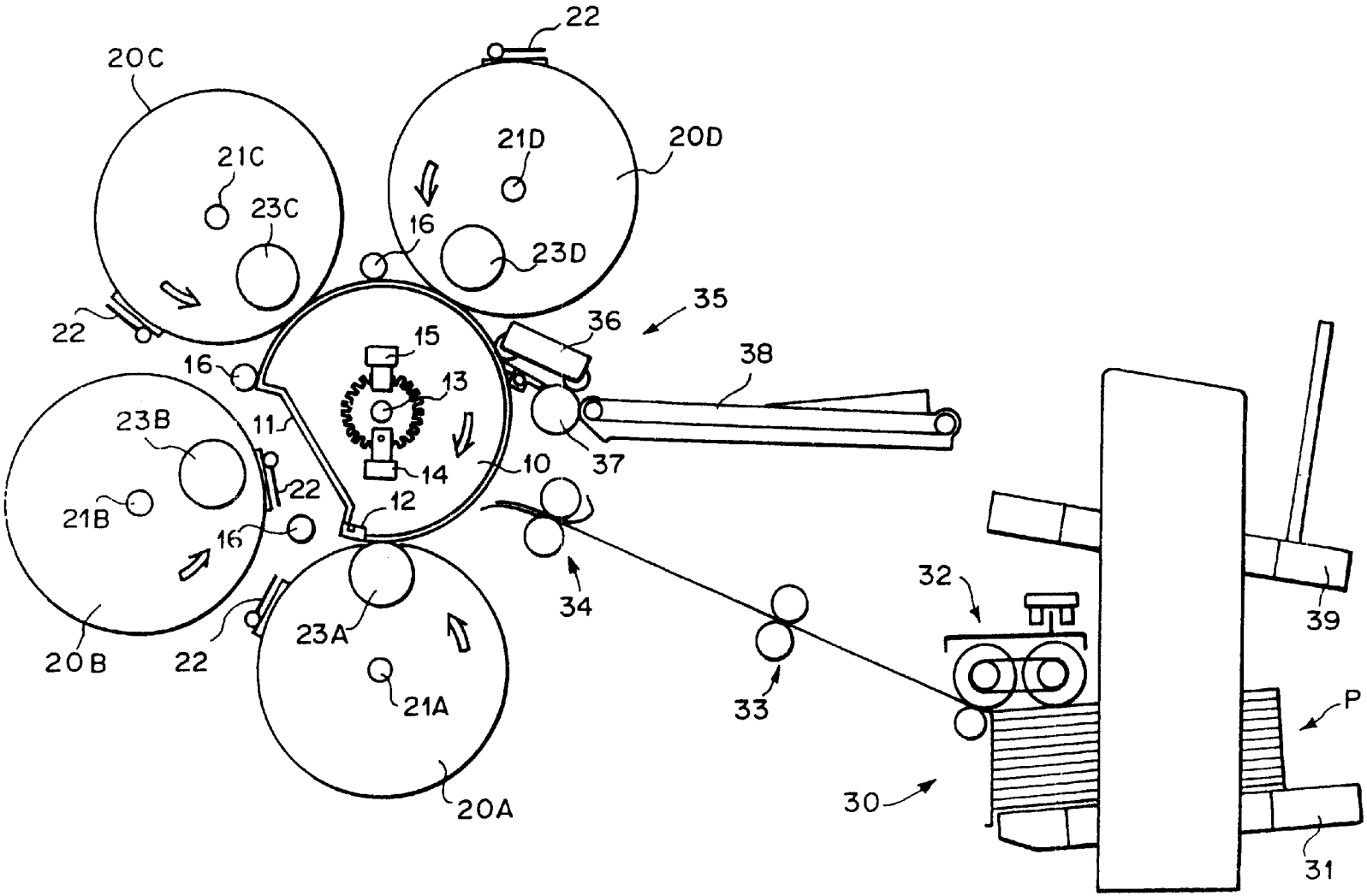
FIG. 1 is a schematic diagram showing an embodiment of a stencil printer according to the present invention.

Referring now in greater detail to the drawings and initially to FIG. 1, there is shown a preferred embodiment of a stencil printer in accordance with the present invention.

In FIG. 1, around a paper pinch drum 10 which is driven to rotate clockwise, a first through a fourth printing drum 20A, 20B, 20C, 20D are disposed in order near a paper pinch drum 10 and along the direction of rotation (i.e., the conveying direction of printing paper P) of the paper pinch drum 10, the printing drums 20A to 20D each having an axis parallel with the axis of the paper pinch drum 10 and the same diameter as the paper pinch drum 10. The drum portions of the printing drums 20A to 20D are each constructed by a mesh-like material wound in cylindrical form.

The printing drums 20A to 20D are driven to rotate in the opposite direction from the rotation of direction of the paper pinch drum 10, i.e., in synchronization with the counter-clockwise direction, with printing drum shafts 21A to 21D as centers, respectively. A portion along the generating line of each printing drum is provided with a stencil-paper anchor 22 which anchors one end of a stencil paper wound around the outer peripheral surface of the printing drum.

The outer peripheral surface of the paper pinch drum 10 is formed with a cutout 11 extending along the generating line in the axial direction of the paper pinch drum 10. This cutout 11 is provided for receiving the stencil-paper anchors 22 of the printing drums 20A to 20D in order. That is, the cutout 11 and the stencil-paper anchors 22 are constructed such that the stencil-paper anchors 22 are aligned in order with the cutout 11 when the printing drums 20A to 20D rotate in synchronization with the paper pinch drum 10 (see FIGS. 1 and 3). The paper pinch drum 10 has a paper claw 12 near the cutout 11, the paper claw 12 being used for anchoring one end of the printing paper P.

In this case, the printing drums 20A to 20D are driven to rotate with a predetermined phase difference held at all times therebetween so that (1) first the first printing drum 20A can print a first image on the printing paper P in a first color ink (e.g., red ink), (2) then, the second printing drum 20B can print a second image on the printing paper P in a second color ink (e.g., yellow ink) with the second image being superimposed on the first image, (3) next, the third printing drum 20C can print a third image on the printing paper P in a third color ink (e.g., blue ink) with the third image being superimposed on the first image and the second image, and (4) finally, the fourth printing drum 20D can print a fourth image on the printing paper P in a fourth color ink (e.g., black ink) with the fourth image being superimposed on the first image, the second image, and the third image.

Inside the printing drums 20A to 20D, ink-containing internal press rollers 23A to 23D and ink supply sections (not shown) are respectively disposed. These 4 internal press rollers 23A to 23D contain red ink, yellow ink, blue ink, and black ink, respectively.

These internal press rollers 23A to 23D are disposed to roll in contact with the inner peripheral surfaces of the printing drums 20A to 20D and are driven between an operative position (see FIG. 2) which performs printing on the printing paper P held on the outer peripheral surface of the paper pinch drum 10 by the paper claw 12 and an inoperative position (see FIGS. 3 and 4) which performs no printing, by a first roller drive mechanism and a second roller drive mechanism. The first roller drive mechanism comprises a stationary cam 66 and a cam follower 68 to be described later. The second roller drive mechanism includes a rotary cam 60 and a cam follower 63 to be described infra. The rotary cam 60 is driven by an electro-magnetic clutch 43. The operation start point of each of the printing drums 20A to 20D is set to an operative position such that satisfactory printing can be performed from an effective printing surface. The reason for this is that if an operative position is too far away from a printing surface, a bounce of the press rollers or an omission of printing will occur on the top of an image.

A paper supply section 30 for the printing paper P has the same construction as in ordinary stencil printers and includes a pair of paper supply rollers 32 which perform an interlock control for taking sheets of printing paper P stacked on a paper supply bed 31 out one by one. The printing paper P is conveyed to the paper pinch drum 10 via timing rollers 33, 34. This paper supply section 30 is disposed on an upstream side of the paper conveying path from the first printing drum 20A, and in the regular printing process, the printing paper P supplied from the paper supply section 30 is first printed by the first printing drum 20A and then is printed in the order of second printing drum 20B, third printing drum 20C, and fourth printing drum 20D. That is, with a single supply of printing paper, printing by all the printing drums can be performed.

A paper discharge section 35 is disposed on a downstream side of the paper conveying path from the last printing drum, i.e., the fourth printing drum 20D. After the printing paper P has been printed by the fourth printing drum 20D, it is discharged by the paper discharge section 35. The paper discharge section 35 comprises a pinch roller unit 36, a paper discharge roller 37, and a paper discharge section 38. The printed paper discharged from the paper discharge section 38 is stacked on a paper discharge bed 39.

The paper supply section 30 and the paper discharge section 35 are disposed between the first printing drum 20A and the fourth printing drum 20D in order to meet the above-mentioned condition. The paper supply section 30 and the paper discharge section 35 are thus disposed on the same side. Therefore, duplex printing also becomes possible if only printing paper printed on once is moved as it is (without being turned over) from the paper discharge table 39 onto the paper supply table 31.

The paper pinch drum shaft 13 is provided with a reference position detection section 14 and a rotational position detection section 15. The reference position detection section 14 detects a reference position for the paper pinch drum 10 and generates a single detection pulse for each rotation of the paper pinch drum 10. The rotational position detection section 15 comprises a pulse encoder which detects the rotational position of the paper pinch drum 10 for each rotation of the paper pinch drum 10 and counts pulses, based on a detection signal from the reference position detection section 14. Note that the reference position detection section 14 and the rotational position detection section 15 can also be provided on the sides of the printing drum shafts 21A to 21D.

Though not shown, adjustment mechanisms are respectively provided in the printing drums. The adjustment mechanisms can adjust the printing drum alone and can also adjust a plurality of printing drums at the same time.

Figure 5:
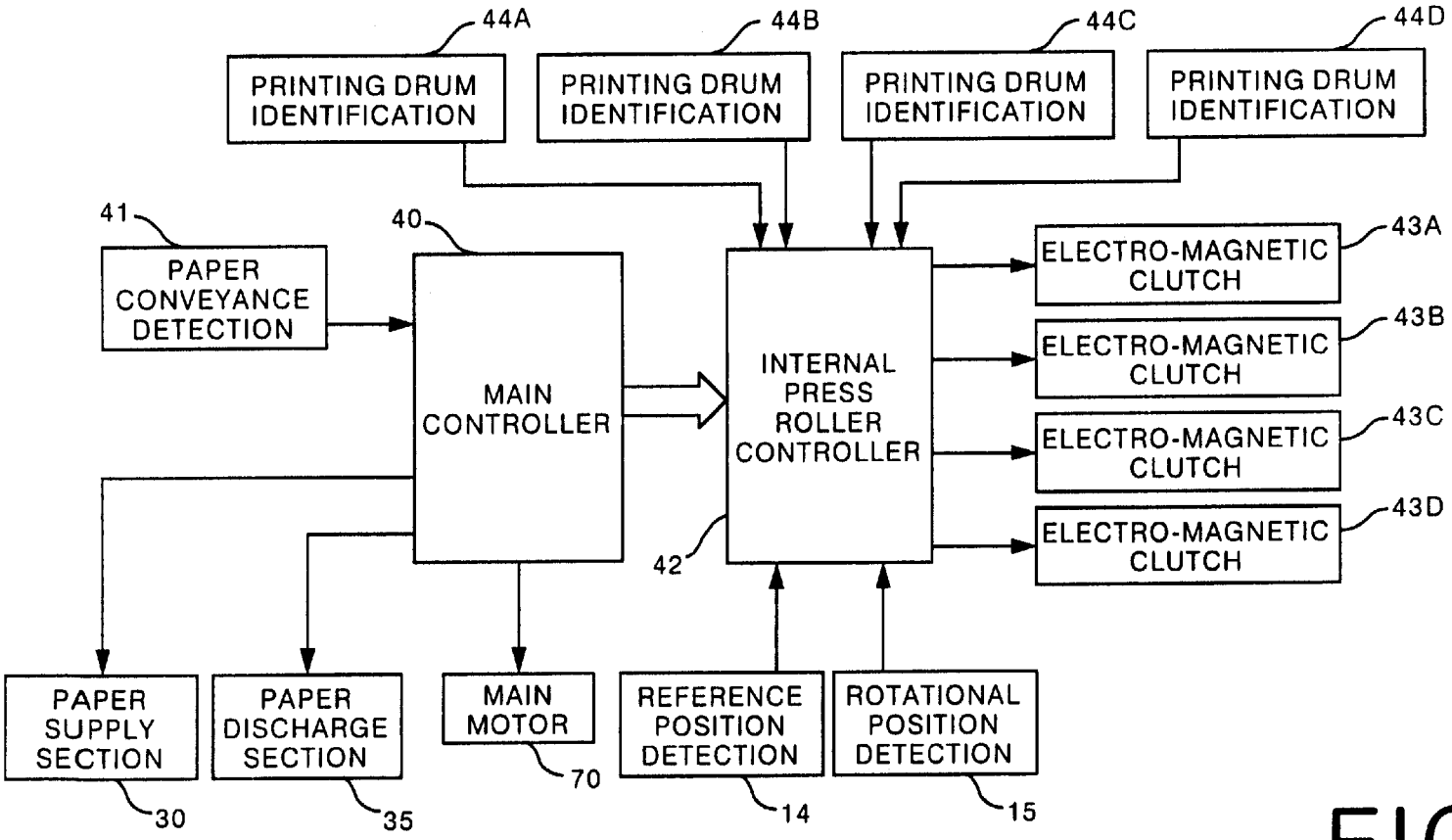
FIG. 5 is a block diagram of a system for controlling the internal press rollers.

FIG. 5 shows a system for controlling the internal press rollers. In the case where printing is performed by a plurality of printing drums, paper conveyance detectors 41 are disposed between the paper supply section 30 and the paper discharge section 35 and between adjacent printing drums so that they can detect abnormal paper conveyance. When any detector 41 detects abnormal paper conveyance, a main controller 40 stops the operation of the paper supply section 30 at once and also transmits a command signal, which releases the printing operation of each printing drum, to an internal press roller controller 42. In this way, the internal press roller controller 42 controls the electro-magnetic clutches 43A to 43D provided in the printing drums 20A to 20D, thereby moving all the internal press rollers 23A to 23D to the inoperative positions.

Now, a drive mechanism for the internal press rollers 23A to 23D will be described with reference to FIGS. 2 through 4. Note that the printing drums 20A to 20D have the same construction and therefore only one of the printing drums is described and shown as a printing drum 20 in FIGS. 2 through 4. Likewise, the printing drum shaft, the internal press roller, and the electro-magnetic clutch are shown as a printing drum shaft 21, an internal press roller 23, and an electro-magnetic clutch 43, respectively.

Inside the printing drum 20, there is provided an internal press arm 52, which is pivotally supported at its base portion on a support shaft 51 stood up in one end (right end in FIG. 2) of an in-drum frame body 50. The internal press roller 23 is rotatably attached to a shaft 53 provided at the intermediate position of the internal press arm 52. The printing drum 20 is further provided with an in-drum main gear 54, which rotates the internal press roller 23 by way of an intervening gear 55 and a driven gear 56. The in-drum gear 54 rotates on the center of the printing drum 20. The intervening gear 55 rotates on a shaft 58 provided on one end portion of an arm member 57 having the central point of the printing drum 20 as a fulcrum. The driven gear 56 rotates on the shaft 53 of the internal press roller 23. Between the other end of the arm member 57 and the in-drum frame body 50, a tension spring 59 is interposed for urging the arm member 57 in the counterclockwise direction of FIG. 2.

If the above-mentioned 3 gears 54, 55, 56 rotate, moment of rotation is applied to the intervening gear 55 and causes the intervening gear 55 to move toward the space between the in-drum main gear 54 and the driven gear 56, and consequently, the internal press roller 23 is pushed downward toward the paper pinch drum 10.

A cam shaft 61 having the rotary cam 60 mounted thereon is rotatably attached to the other end (left end in FIG. 2) of the in-drum frame body 50. This cam shaft 61 is linked to a gear 62 through an electro-magnetic clutch 43, and the gear 62 is provided coaxially with the cam shaft 61 and meshes with the in-drum main gear 54.

The cam 60 has a pair of opposite cam surfaces 60*a* spaced a predetermined first distance equally from the center of rotation of the cam shaft 61 and a pair of opposite cam surfaces 60*b* spaced equally from the center of rotation of the cam shaft 61 a predetermined second distance greater than the predetermined first distance. The cam surfaces 60*a*, 60*b* differ in phase by 90°. A link yoke 64 is slidably provided in the vertical direction of FIG. 2 and includes a yoke cam follower 63 which selectively engages the cam surfaces 60*a*, 60*b*. The lower end of the link yoke 64 is linked to the tip portion of the internal press arm 52 by means of a pin 65.

Inside the printing drum 20, a cam 66 with a cam surface 66*a* coaxial with the printing drum 20 is fixedly provided in an area corresponding to the stencil-paper anchor 22. During rotation of the printing drum 20, this cam 66, as shown in FIG. 3, engages the cam follower 68 mounted on the shaft 53 of the internal press roller 23 when the cam 66 passes the internal press roller 23, thereby moving the internal press roller 23 inwardly in the radial direction of the printing drum 20. This radially inward movement causes the internal press arm 52 to pivot clockwise on the pivot shaft 51 and therefore the link yoke 64 moves upward.

During normal printing, the electro-magnetic clutch 43 is caused to be in a disconnected state. In the disconnected state of the electro-magnetic clutch 43, as shown in FIGS. 2 and 3, the cam surfaces 60*a* of the cam 60 nearer to the center of rotation of the cam 60 are directed up and down, and the internal press roller 23 is movable up and down by a first internal press roller drive mechanism. The first internal press roller drive mechanism comprises the cam 66 and the cam follower 68.

On the other hand, the up-and-down movement of the internal press roller 23 at the time of printing start and end and at the time of urgent end because of a jam is performed by rotation of the rotary cam 60. The rotation of the rotary cam 60 is performed when the internal press roller controller 42 causes the electro-magnetic clutch 43 to be in a connected state or in a disconnected state. That is, when printing ends or when printing ends urgently because of a jam, the electro-magnetic clutch 43 is caused to be in the connected state by the internal press roller controller 42 and the cam 60 is rotated by 90° from the position shown in FIG. 2 to the position of FIG. 4 where the cam surface 60*b* of the cam 60 on the far side from the center of rotation of the cam 60 engages the cam follower 63. If the cam 60 is further rotated by 90°, the electro-magnetic clutch 43 is caused to be in the disconnected state by the internal press roller controller 42. In the connected state of the electro-magnetic clutch 43, the link yoke 64 with the cam follower 63 is moved upward, as a result of which the internal press arm 52 is pivoted clockwise on the pivot shaft 51. This clockwise movement causes the internal press roller 23 to move from the printing position shown in FIG. 2 to the non-printing position shown in FIG. 4.

Figure 2:
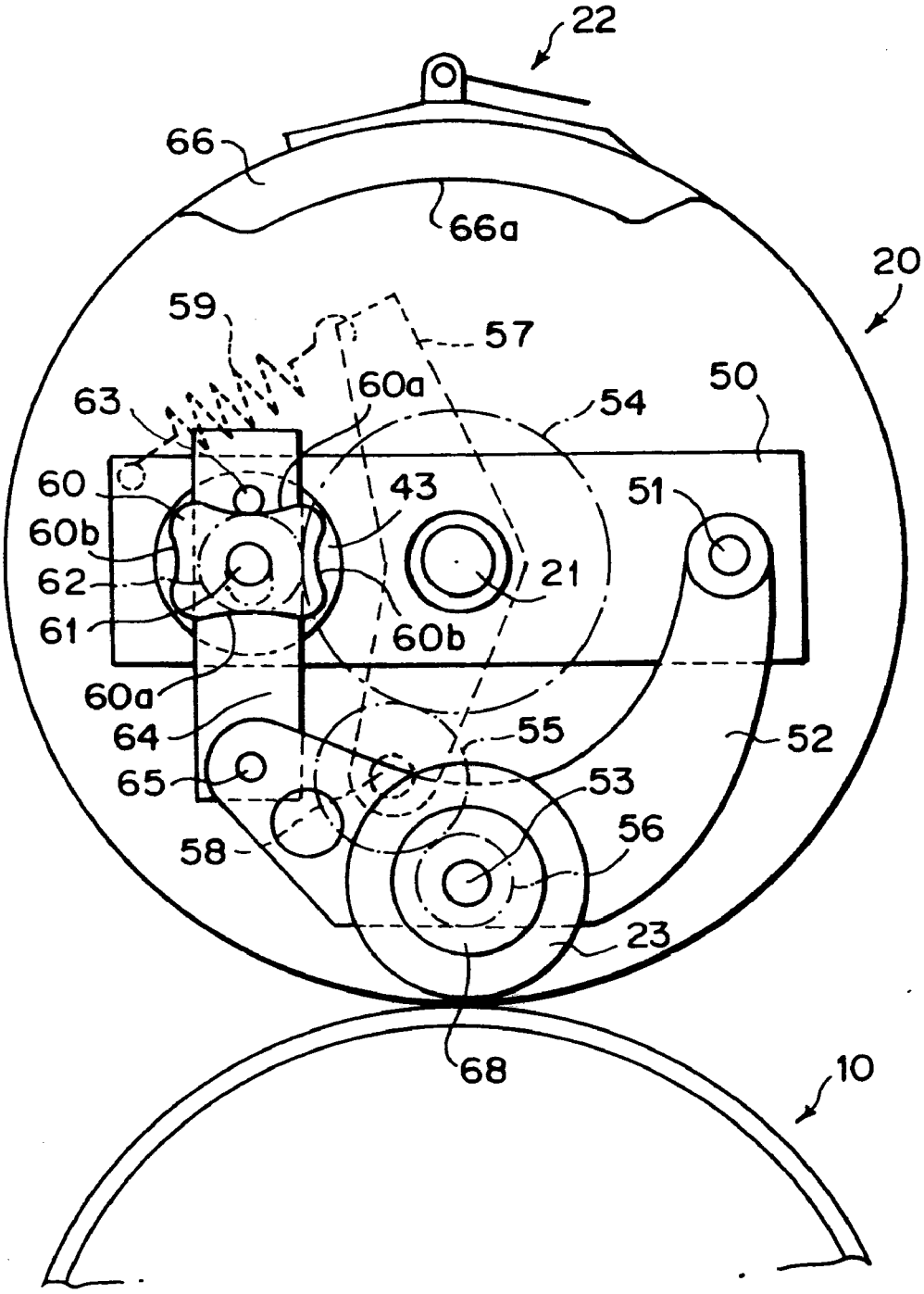
FIG. 2 is a side view showing the essential parts of a drive mechanism for the internal press roller of the stencil printer in the printing execution state.
Figure 3:
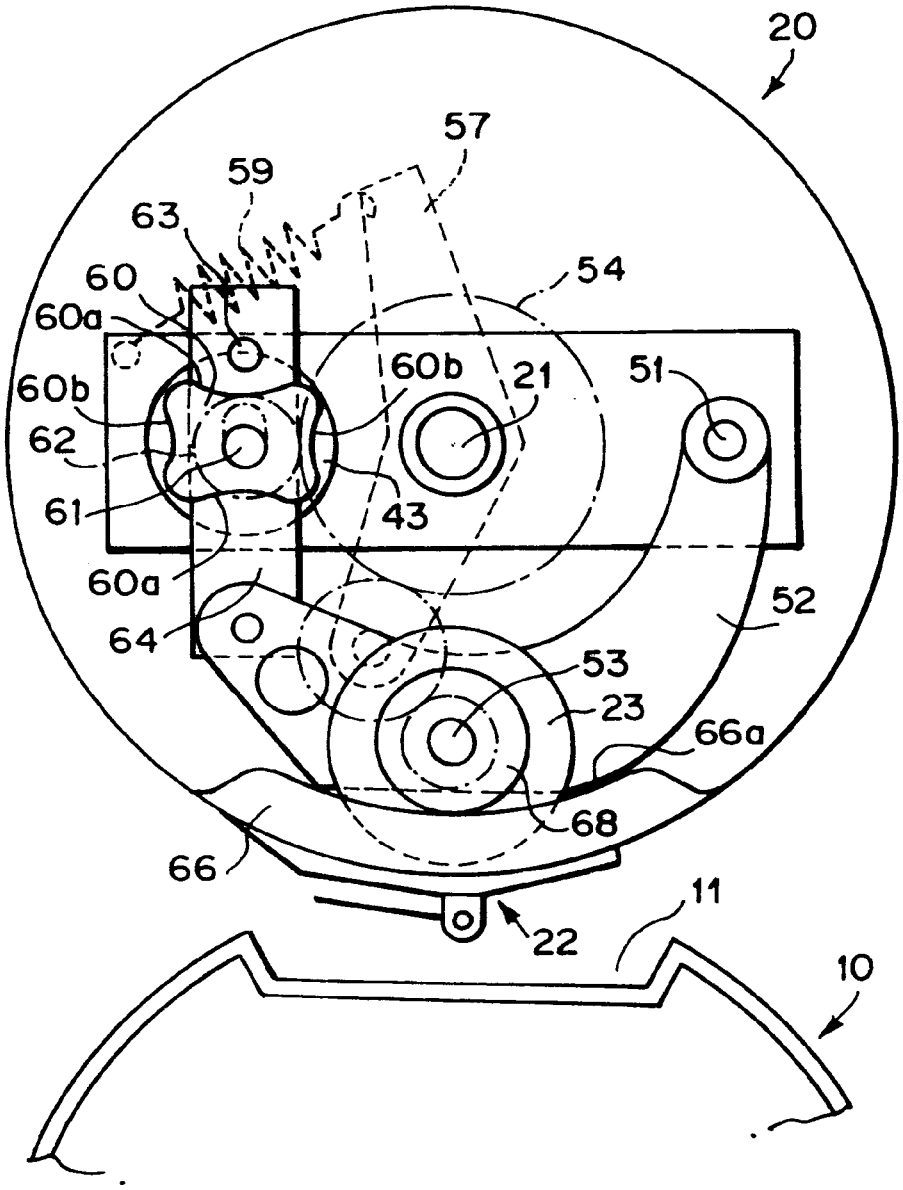
FIG. 3 is a view similar to FIG. 2 showing the internal press roller moved to a non-printing position during normal printing.

When printing is started, the electro-magnetic clutch 43 is caused to be in the disconnected state by the internal press roller controller 42 and the cam 60 is rotated by 90° to the position of FIG. 2 where the cam surface 60*a* on the near side from the center of rotation engages the cam follower 63. If the cam 60 is further rotated by 90°, the electro-magnetic clutch 43 is caused to be in the connected state by the internal press roller controller 42. In the disconnected state of the electro-magnetic clutch 43, the link yoke 64 with the cam follower 63 is moved downward, as a result of which the internal press arm 52 is pivoted counterclockwise on the pivot shaft 51. This counterclockwise movement causes the internal press roller 23 to move from the non-printing position shown in FIG. 4 to the printing position shown in FIG. 2.

Thus, the up-and-down movement of the internal press roller 23 at the time of printing start and end and, at the time of urgent end because of a jam, is performed by a second internal press roller drive mechanism which is operated by the electro-magnetic clutch 43 that is disconnected or connected by the internal press roller controller 42. The second internal press roller drive mechanism comprises the rotary cam 60 and the cam follower 63.

In this case, the internal press roller controller 42 shown in FIG. 5 controls the internal press rollers 23A to 23D, based on information from the rotational position detection section 15, and moves the internal press roller to the operative position when the position of rotation of the paper pinch drum 10 detected by the rotational position detection section 15 coincides with a predetermined operation start point for the internal press roller. The internal press roller controller 42 also moves the internal press roller to the inoperative position when the position of rotation of the paper pinch drum 10 detected by the rotational position detection section 15 coincides with a predetermined operation end point for the internal press roller.

Now, various printing forms employing the first through the fourth printing drum 20A to 20D shown in FIG. 1 will be described with reference to FIG. 5.

In the case of performing normal printing (non-reverse image printing) on the surface of the printing paper P by employing the first through the fourth printing drum 20A to 20D mentioned above, a mirror image stencil paper (a master mirror image) is first wound around each printing drum. Then, the internal press roller controller 42 starts printing in order from the first printing drum 20A (i.e., the internal press rollers 23A to 23D are moved in order to the operative positions) by employing a signal from the above-mentioned rotational position detection section 14. When printing ends, the internal press roller controller 42 similarly ends printing in order from the first printing drum 20A (i.e., the internal press rollers 23A to 23D are moved in order to the inoperative positions).

Figure 4:
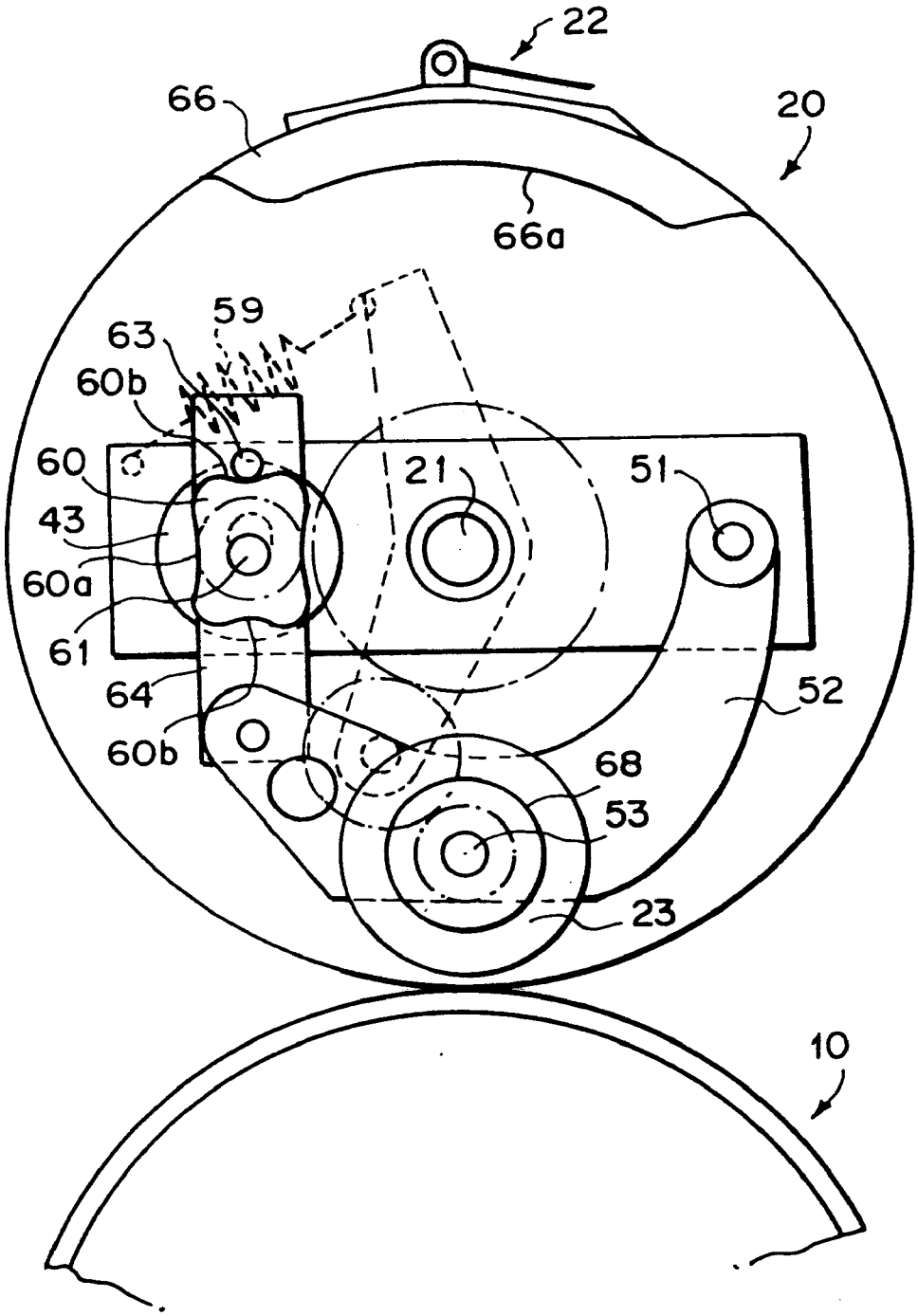
FIG. 4 is a side view showing the essential parts of the drive mechanism for the internal press roller in the printing end state.

In the case of performing printing without employing a particular printing drum of the above-mentioned 4 printing drums 20A to 20D, for example, in the case of performing printing without employing the third printing drum 20C, printing is performed, with only the internal press roller 23C of the third printing drum 20C held in the inoperative position shown in FIG. 4 by the internal press roller controller 42.

Note that in the case where there is a non-printing drum, a non-perforated stencil paper (an airtight master) is wound around the outer peripheral surface of the non-printing drum so that the rear end of the printing paper P is not stained by ink on the non-printing drum.

In addition, in the case where only a specific printing drum of a plurality of printing drums is employed in printing, a pair of guide rollers 16, which is driven in contact with the outer peripheral surface of the paper pinch drum 10, is disposed between adjacent printing drums so that the rear end of the printing paper P is not stained by ink on the non-printing drum. These guide rollers 16 can adjust the spacing therebetween in the axial direction of the paper pinch drum 10 in accordance with the size of the printing paper P and has a function of pressing the non-printing areas of the longitudinally opposite portions of the printing paper P and preventing the printing paper P from being separated from the outer peripheral surface of the paper pinch drum 10.

The stencil printer of the present invention is also capable of performing printing on both sides of the printing paper P.

For example, consider the case of performing printing (non-reverse image printing) on the obverse side of the printing paper P by the first printing drum 20A, the second printing drum 20B, and the fourth printing drum 20D and performing printing (non-reverse image printing) on the reverse side of the printing paper P by the third drum 20C. Mirror image stencil papers (master mirror images) are wound around the first drum 20A, the second drum 20B, and the fourth drum 20D. A non-reverse image stencil paper (a master non-reverse image) is wound around the third printing drum 20C. The main controller 40 causes the paper supply section 30 to stop a paper supplying operation. In addition, the internal press roller controller 42 holds the internal press rollers 23A, 23B, 23D of the first, the second, and the fourth printing drum 20A, 20B, 20D in the inoperative positions and causes only the internal press roller 23C of the third printing drum 20C to move to the operative position. In this state, if printing is performed, a mirror image is printed on the outer peripheral surface of the paper pinch drum 10 by the third printing drum 20C.

Next, the main controller 40 causes the paper supply section 30 to start the paper supplying operation. The internal press roller controller 42 holds only the internal press roller 23C of the third printing drum 20C in the inoperative position and causes the internal press rollers 23A, 23B, 23D of the first printing drum 20A, the second printing drum 20B, and the fourth printing drum 20D to move to the operative positions in order. In this state, if printing is performed, non-reverse image printing is performed on the obverse side of the printing paper P by the first printing drum 20A, the second printing drum 20B, and the fourth printing drum 20D. Simultaneously, the mirror image, printed on the outer peripheral surface of the paper pinch drum 10 by the third printing drum, is transferred as a non-reverse image to the reverse side of the printing paper P.

That is, during duplex printing, the paper pinch drum 10 fulfills a function as an ordinary paper pinch drum and a function as a blanket paper pinch drum which transfers an image. The printing drum for printing a non-reverse image has a function as a pressure roller for transferring an image to the reverse side of the printing paper P. For instance, in the case where the fourth printing drum 20D on most downstream side is not employed in printing a non-reverse image, if a non-perforated stencil paper (an airtight master) is wound around this printing drum 20D and the printing drum 20D is used as a pressure roller, the image transferred to the reverse side of the printing drum P can be further stabilized.

When the stencil paper is manufactured, a portion of the stencil paper other than the printing area is formed with a cutout or a circular opening for identifying if this stencil paper is a master mirror image or a master non-reverse image. Sensors 44A to 44D for identifying the type of each of the stencil papers wound around the printing drums 20A to 20D are provided on the main body side of the printer, and information from each of the sensors 44A to 44D is input to the internal press roller controller 42 (see FIG. 5).

Figure 6:
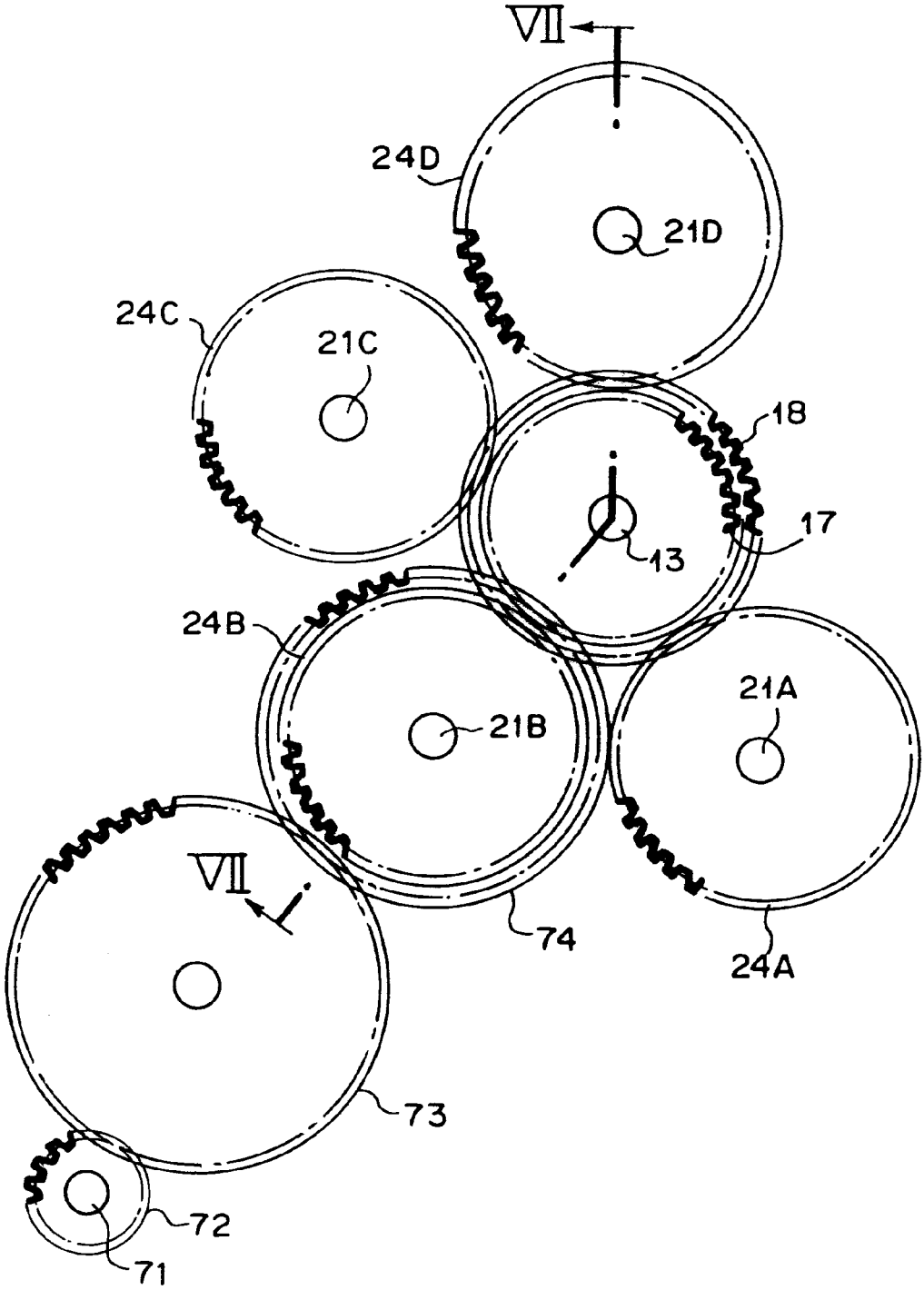
FIG. 6 is a schematic diagram showing a rotational drive system for a paper pinch drum and a plurality of printing drums.

Now, a construction example of the drive mechanism of the paper pinch drum 10 and the printing drums 20A to 20D will be described with reference to FIG. 6 which shows a gear train and FIG. 7 which is a sectional view taken along line VII—VII of FIG. 6.

As shown in the figures, two gears 17, 18 differing in diameter are coaxially mounted on the above-mentioned paper pinch drum shaft 13, and a driving gear 72 is mounted on the rotating shaft 71 of a main motor 70 (see FIG. 5) which is controlled by the main controller 40. Rotation of the driven gear 72 is transmitted to one (gear 17) of the two driven gears 17, 18 by way of idle gears 73, 74. With this arrangement, the paper pinch drum 10 is constructed such that it is directly driven to rotate by the main motor 70 via a first rotation transmission system which comprises the driving gear 72, the idle gears 73, 74, and the driven gear 17.

In addition, the other driving gear 18 mounted on the paper pinch drum shaft 13 meshes with all driven gears 24A to 24D respectively mounted on the printing drum shafts 21A to 21D having the printing drums 20A to 20D respectively mounted thereon. With this arrangement, the printing drums 20A to 20D are constructed such that they are driven to rotate in the opposite direction from the direction of rotation of the paper pinch drum 10 via a second rotation transmission system comprising the driving gear 18 and the driven gears 24A to 24D. Note that the driven gear 24B and the idle gear 74 coaxially disposed are supported such that they are rotated independently of each other, as described later.

With the aforementioned construction, the driving conditions for the printing drums 20A to 20D can be made the same and a phase difference between the printing drums can be prevented. Note that a drive source may be connected directly to the paper drive shaft 13.

Figure 7:
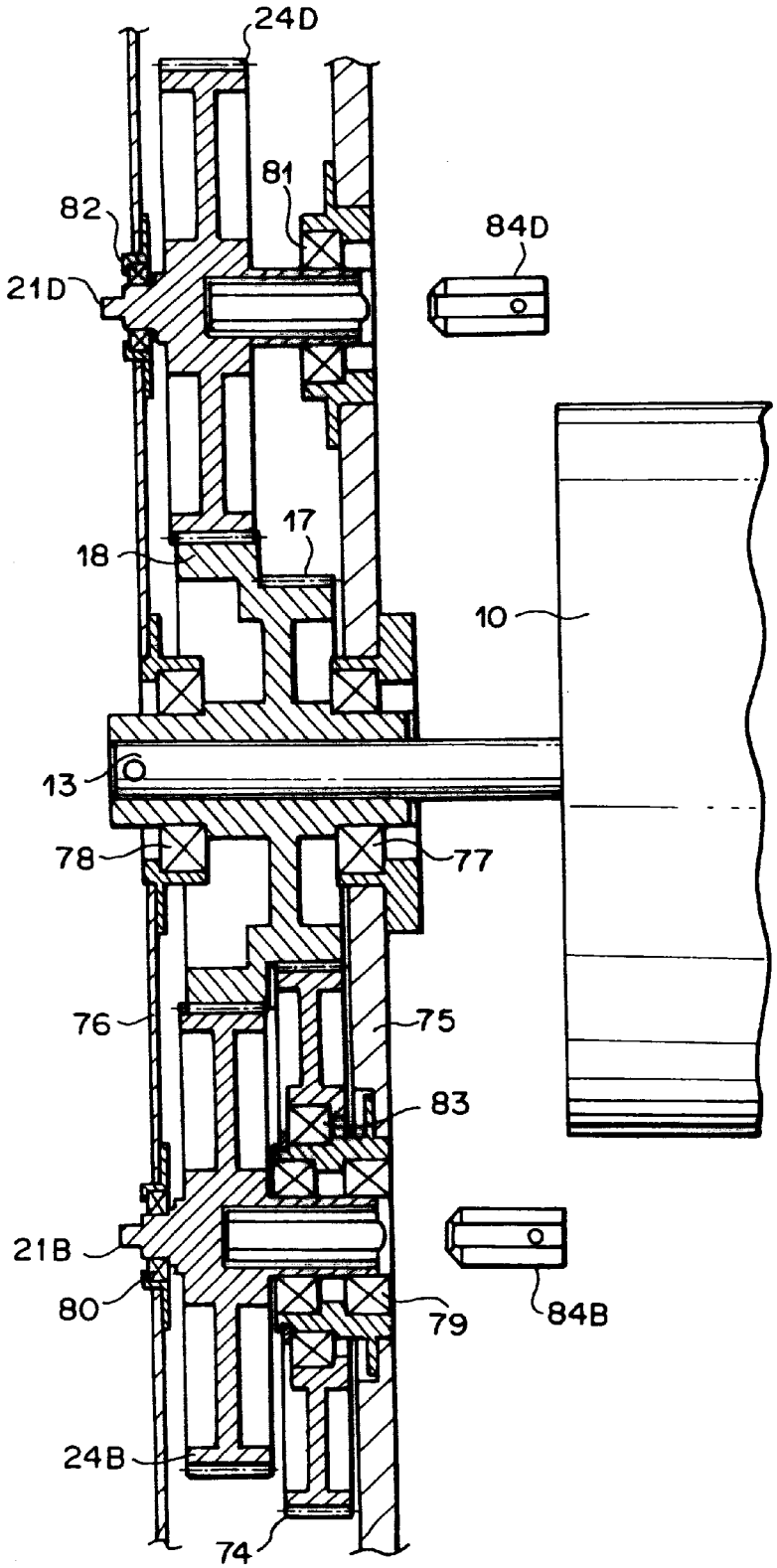
FIG. 7 is an enlarged sectional view taken substantially along line VII—VII of FIG. 6.

One end of the paper pinch drum shaft 13 and one end of each of the printing drum shafts 21A to 21D are rotatably supported on support plates 75, 76 via bearings, as shown in FIG. 7. More specifically, the paper pinch drum shaft 13 is supported by bearings 77, 78 respectively attached to the support plates 75, 76, and the printing drum shaft 21B is supported by bearings 79, 80 respectively attached to the support plates 75, 76. Similarly, the printing drum shaft 21D is supported by bearings 81, 82 respectively attached to the support plates 75, 76. Furthermore, the idle gear 74, which meshes with the driven gear 17 mounted on the paper pinch drum shaft 13, is rotatably supported by a bearing 83 coaxially mounted on the outer surface of the bearing 79 supporting the printing drum shaft 21B. Note that joints 84B, 84D shown in FIG. 7 are used for connecting the printing drum shafts 21B, 21D with the printing drums 20B, 20D, respectively.

According to the preferred embodiment of the present invention, as is evident in the foregoing description, single-side polychromatic printing can be performed by employing all of the above-mentioned 4 printing drums 20A to 20D. In addition, for example, single-side polychromatic printing can be performed by stopping one printing drum and employing the remaining 3 printing drums. Monochromatic printing can also be performed by employing a single printing drum alone. Furthermore, performing duplex printing is easy.

In the above-mentioned embodiment, when duplex printing is performed, a mirror image is first printed on the outer peripheral surface of the paper pinch drum 10 by the third printing drum 20C alone and then the mirror image is transferred to the reverse side of the printing paper P, and consequently, for the reverse side of the printing paper P, single-side printing is performed. In performing duplex polychromatic printing, a plurality of printing drums, as in the obverse side of the printing paper P, can be employed for printing mirror images on the outer peripheral surface of the paper pinch drum 10. In such a case, a stencil printer with four or more printing drums is employed.

Furthermore, in the above-mentioned embodiment, although the paper pinch drum 10 operating in common with respect to 4 printing drums 20A to 20D has the same diameter as the printing drums 20A to 20D, the paper pinch drum 10 may be constructed such that the diameter thereof is an integral multiple of the diameter of the printing drum. For instance, in the case where the diameter of the paper pinch drum 10 is twice the diameter of each printing drum, this paper pinch drum 10 may be provided with two cutouts 11 which are opposite to each other in the diameter direction, i.e., are out of phase by 180°, and two paper claws 12 which are opposite to each other in the diameter direction, i.e., are out of phase by 180°.

What is claimed is:

1. A stencil printer comprising:

a rotatable paper pinch drum with a cutout, the cutout being formed in a portion of the outer peripheral surface thereof along a generating line in the axial direction of the drum;

a plurality of printing drums having axes parallel with an axis of the paper pinch drum and disposed around and near the paper pinch drum so that the printing drums rotate in synchronization with the paper pinch drum in the opposition direction from the direction of rotation of the paper pinch drum, each of the printing drums including a stencil paper wound around the outer peripheral surface of the printing drum and an internal press roller which supplies ink to the stencil paper, and printing being performed on printing paper held on the outer peripheral surface of the paper pinch drum when the printing drums and the paper pinch drum rotate so that stencil paper clamps of the printing drums are received in order in the cutout of the paper pinch drum wherein during duplex printing the paper pinch drum is adapted to operate as both a blanket paper pinch drum that transfers an image and as the paper pinch drum that anchors one end of the printing paper; and position control means which independently controls each movement of the internal press rollers of the printing drums between an operative position which performs printing on the printing paper and an inoperative position which performs no printing.

2. The stencil printer as defined in claim 1, further comprising:

reference position detection means which detects a reference position in the direction of rotation of the paper pinch drum or the plurality of printing drums; and rotational position detection means which detects a position of rotation from the reference position of the paper pinch drum or the plurality of printing drums, based on information detected by the reference position detection means;

wherein the position control means controls the internal press roller, based on information from the rotational position detection means.

3. The stencil printer as defined in claim 2 in which the position control means moves the internal press roller to the operative position when the position of rotation of the paper pinch drum or the plurality of printing drums, detected by the rotational position detection means, coincides with a predetermined operation start point for the internal press roller.

4. The stencil printer as defined in claim 3 in which the position control means moves the internal press roller to the inoperative position when the position of rotation of the paper pinch drum or the plurality of printing drums, detected by the rotational position detection means, coincides with a predetermined operation end point for the internal press roller.

5. The stencil printer as defined in claim 2 in which the position control means moves the internal press roller to the inoperative position when the position of rotation of the paper pinch drum or the plurality of printing drums, detected by the rotational position detection means, coincides with a predetermined operation end point for the internal press roller.

6. The stencil printer as defined in claim 1 in which at least one of the plurality of printing drums comprises a mirror image printing drum having a mirror-image stencil paper which can print a non-reverse image on the obverse side of the printing paper; and the position control means moves the internal press rollers of the plurality of printing drums to the operative positions in order from the internal press roller of the mirror image printing drum on an upstream side of a conveying path of the printing paper.

7. The stencil printer as defined in claim 6 in which the printing drum of the plurality of printing drums on the most downstream side of the conveying path of the printing paper comprises a press printing drum around which a non-perforated stencil paper is wound.

8. The stencil printer as defined in claim 1 in which the paper pinch drum is directly driven to rotate by a drive source via a first rotation transmission system and the plurality of printing drums are driven to rotate by the paper pinch drum via a second rotation transmission system.

9. The stencil printer as defined in claim 1 in which guide rollers, which press the printing paper on the paper pinch drum by contacting the paper pinch drum being driven to rotate and are driven by the paper pinch drum, are disposed between the plurality of printing drums.

10. A stencil printer comprising:

a rotatable paper pinch drum with a cutout, the cutout being formed in a portion of the outer peripheral surface thereof along a generating line in the axial direction of the drum;

a plurality of printing drums having axes parallel with an axis of the paper pinch drum and disposed around and near the paper pinch drum so that the printing drums rotate in synchronization with the paper pinch drum in the opposition direction from the direction of rotation of the paper pinch drum, each of the printing drums including a stencil paper wound around the outer peripheral surface of the printing drum and an internal press roller which supplies ink to the stencil paper, and printing being performed on printing paper held on the outer peripheral surface of the paper pinch drum when the printing drums and the paper pinch drum rotate so that the stencil paper clamps of the printing drums are received in order in the cutout of the paper pinch drum, wherein at least one of the plurality of printing drums comprises a mirror image printing drum around which a mirror image stencil paper, which can print a non-reverse image on the obverse side of the printing paper, is wound;

at least one of the remaining printing drums comprises a non-reverse image printing drum around which a non-reverse image stencil paper, which can print a mirror image on the outer peripheral surface of the paper pinch drum is wound; and position control means which independently controls each movement of the internal press rollers of the printing drums between an operative position which performs printing on the printing paper and an inoperative position which performs no printing, wherein the position control means moves only the internal press roller of the non-reverse image printing drum to the operative position and prints the mirror image on the outer peripheral surface of the paper pinch drum, without winding the printing paper around the paper pinch drum, and then moves the internal press roller of the non-reverse image printing drum to the inoperative position and the internal press roller of the mirror image printing drum to the operative position, with the printing paper wound around the paper pinch drum, and prints the non-reverse image on the obverse side of the printing paper and transfers the mirror image printed on the outer peripheral surface of the paper pinch drum to the reverse side of the printing paper as a non-reverse image.

* * * * *